US011108197B2

(12) United States Patent
Sjolund

(10) Patent No.: US 11,108,197 B2
(45) Date of Patent: Aug. 31, 2021

(54) POWER CABLE ASSEMBLY

(71) Applicant: Kirk Sjolund, Denver, CO (US)

(72) Inventor: Kirk Sjolund, Denver, CO (US)

( * ) Notice: Subject to any disclaimer, the term of this patent is extended or adjusted under 35 U.S.C. 154(b) by 1 day.

(21) Appl. No.: 16/675,615

(22) Filed: Nov. 6, 2019

(65) Prior Publication Data

US 2021/0135407 A1 May 6, 2021

(51) Int. Cl.

| | |
|---|---|
| ***H01R 13/70*** | (2006.01) |
| ***H01R 25/00*** | (2006.01) |
| ***H01R 27/02*** | (2006.01) |
| ***H01R 13/717*** | (2006.01) |

(52) U.S. Cl.

CPC ..... *H01R 13/701* (2013.01); *H01R 13/7175* (2013.01); *H01R 25/003* (2013.01); *H01R 27/02* (2013.01)

(58) Field of Classification Search

CPC ..... H01R 13/701; H01R 13/7175; H01R 25/003; H01R 27/02

See application file for complete search history.

(56) References Cited

U.S. PATENT DOCUMENTS

| | | | | |
|---|---|---|---|---|
| 5,453,916 | A * | 9/1995 | Tennis | E01F 9/669 362/152 |
| 5,931,702 | A | 8/1999 | Fladung | |
| 6,113,198 | A | 9/2000 | Hommes | |
| 9,768,528 | B2 | 9/2017 | Lucantonio | |
| 10,454,289 | B2 * | 10/2019 | Chien | F21V 33/0004 |
| 2008/0280475 | A1 | 11/2008 | Byrne | |
| 2012/0282814 | A1 | 11/2012 | Houdek | |
| 2014/0184930 | A1 | 7/2014 | Haxton | |

FOREIGN PATENT DOCUMENTS

| | | |
|---|---|---|
| WO | WO2014032123 | 3/2014 |

* cited by examiner

*Primary Examiner* — Briggitte R. Hammond

(57) ABSTRACT

A power cable assembly includes a lamp that has a base. A power cord extends outwardly from the base and the power cord is electrically coupled to a power source comprising a female electrical outlet. A housing is provided and the power cord extends through the housing. The housing has a first power port and a second power port. Each of the first power port and the second power port is in electrical communication with the power cord. A surge protector is positioned within the housing to protect the power cord, the first power port and the second power port from electrical surges. Each of the first power port and the second power port can supply electrical power for an electronic device.

5 Claims, 4 Drawing Sheets

POWER CABLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to power cable device and more particularly pertains to a new power cable device for powering electronic devices with a lamp.

(2) Description of Related Art Including Information Disclosed Under 37 CFR 1.97 and 1.98

The prior art relates to power cable device.

BRIEF SUMMARY OF THE INVENTION

An embodiment of the disclosure meets the needs presented above by generally comprising a lamp that has a base. A power cord extends outwardly from the base and the power cord is electrically coupled to a power source comprising a female electrical outlet. A housing is provided and the power cord extends through the housing. The housing has a first power port and a second power port. Each of the first power port and the second power port is in electrical communication with the power cord. A surge protector is positioned within the housing to protect the power cord, the first power port and the second power port from electrical surges. Each of the first power port and the second power port can supply electrical power for an electronic device.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
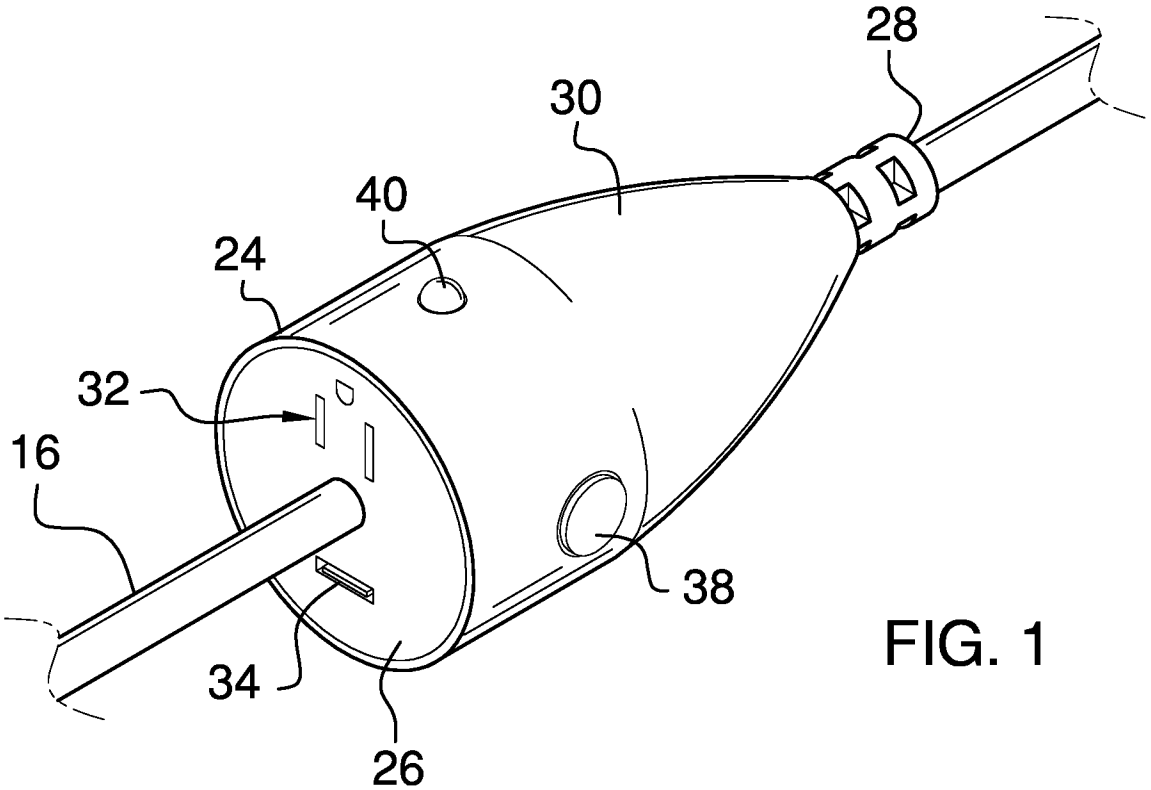
FIG. 1 is a perspective view of housing and a power cord of a power cable assembly according to an embodiment of the disclosure.
Figure 2:
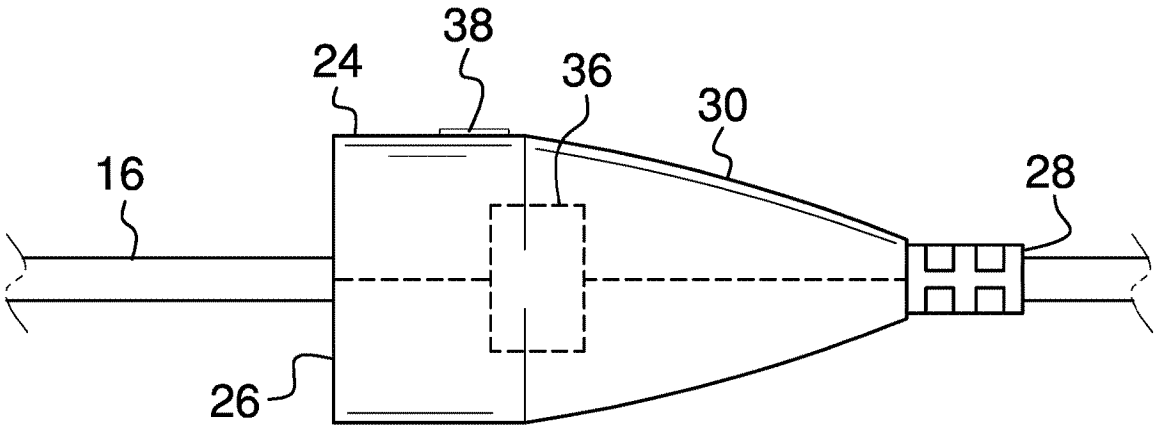
FIG. 2 is a top phantom view of an embodiment of the disclosure.
Figure 3:
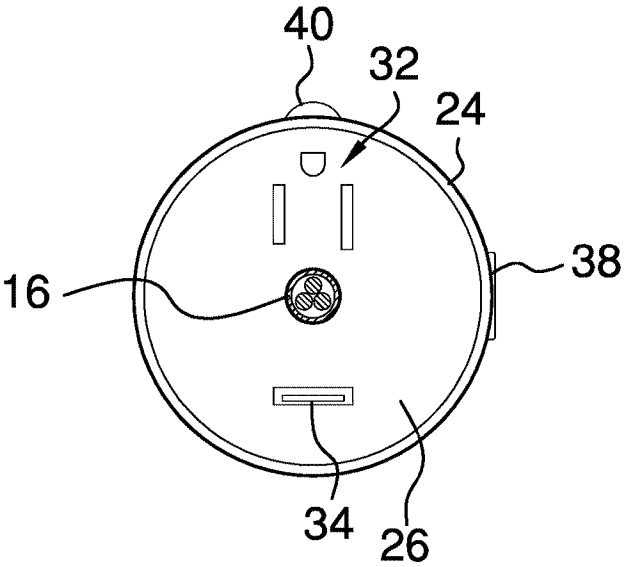
FIG. 3 is a front cut-away view of an embodiment of the disclosure.
Figure 4:
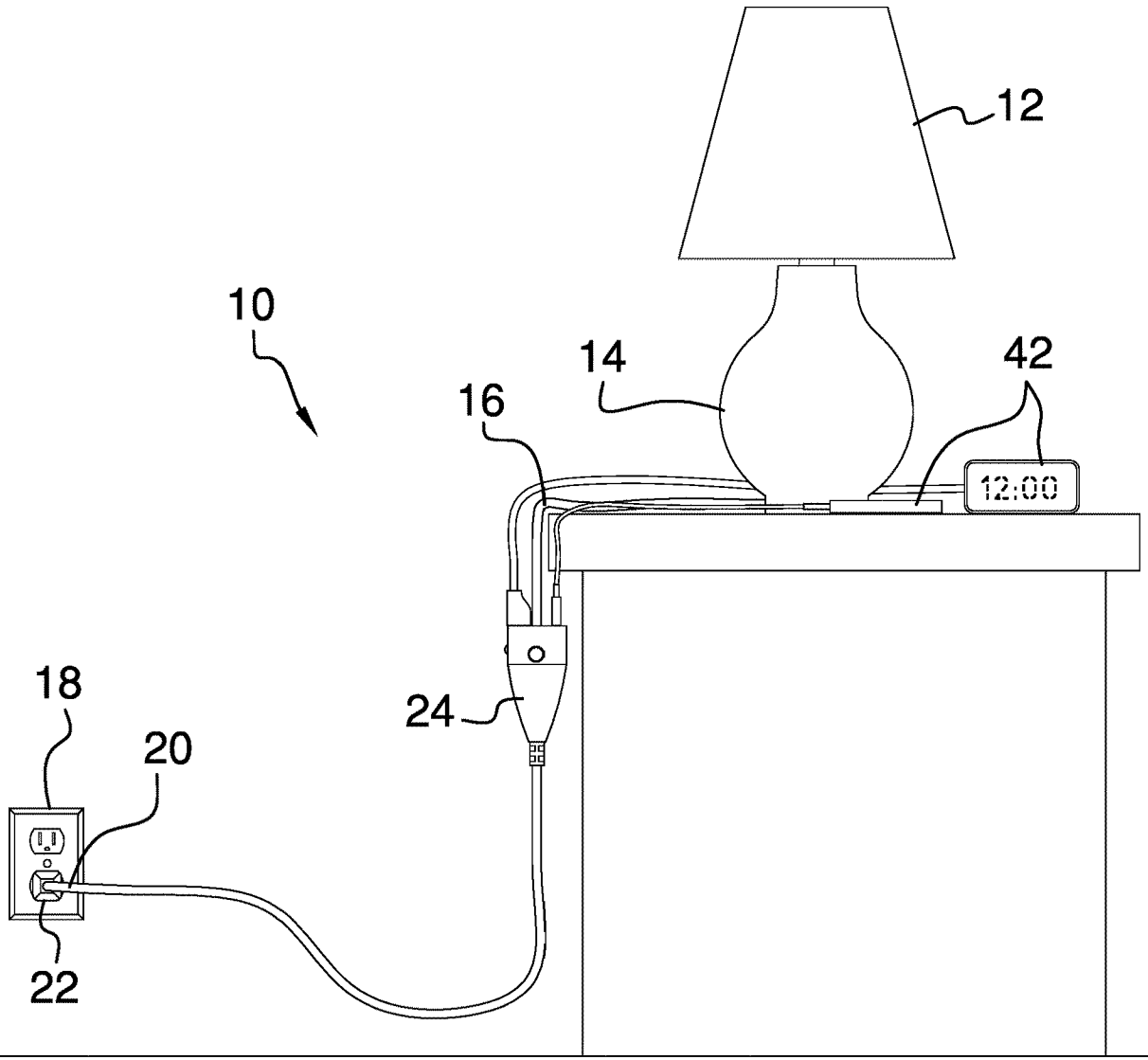
FIG. 4 is a perspective in-use view of an embodiment of the disclosure.

With reference now to the drawings, and in particular to FIGS. 1 through 6 thereof, a new power cable device embodying the principles and concepts of an embodiment of the disclosure and generally designated by the reference numeral 10 will be described.

As best illustrated in FIGS. 1 through 6, the power cable assembly 10 generally comprises a lamp 12 that has a base 14. The lamp 12 may be a table lamp or the like that includes a light bulb 13 for illuminating the area in which the lamp 12 is positioned and a power switch 15 or turning the lamp 12 on and off. A power cord 16 extends outwardly from the base 14 and the power cord 16 is electrically coupled to a power source 18 comprising a female electrical outlet. The power cord 16 has a distal end 20 with respect to the base 14 and a male plug 22 is electrically coupled to the distal end 20 for engaging the female electrical outlet. The power switch 15 is electrically coupled to the power cord 16 for supplying electrical power to the light bulb 13.

A housing 24 is provided that has the power cord 16 extending therethrough. The housing 24 has a first end 26, a second end 28 and an outer wall 30 extending therebetween. The outer wall 30 is continuously arcuate about a line extending through the first end 26 and the second end 28 such that the housing 24 has a cylindrical shape. Additionally, the outer wall 30 tapers inwardly between the first end 26 and the second end 28.

The housing 24 has a first power port 32 and a second power port 34. Each of the first power port 32 and the second power port 34 is in electrical communication with the power cord 16. Moreover, each of the first power port 32 and the second power port 34 is positioned on the first end 26 of the housing 24. The first power port 32 may comprise a three prong female electrical outlet and the second power port 34 may comprise a usb port. Additionally, the power cord 16 extends through the first end 26 and the second end 28.

A surge protector 36 is provided and the surge protector 36 is positioned within the housing 24. Each of the power cord 16, the first power port 32 and the second power port 34 is electrically coupled to the surge protector 36. In this way the surge protector 36 protects the power cord 16, the first power port 32 and the second power port 34 from electrical surges. The surge protector 36 may be an electronic surge protector 36 of any conventional design.

Figure 5:
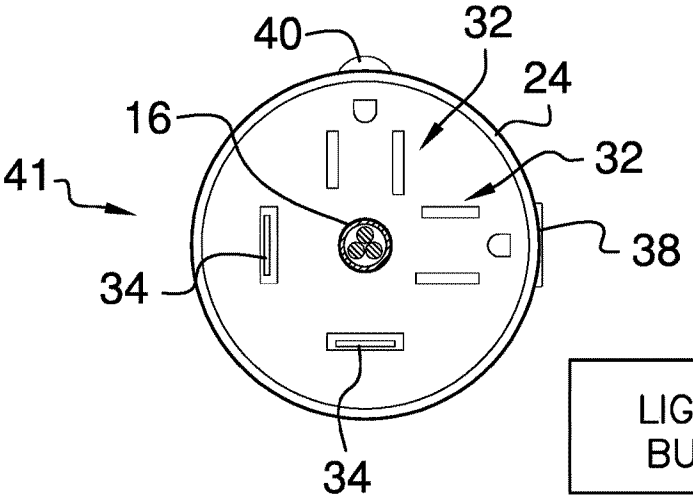
FIG. 5 is a front view of an alternative embodiment of the disclosure.
Figure 6:
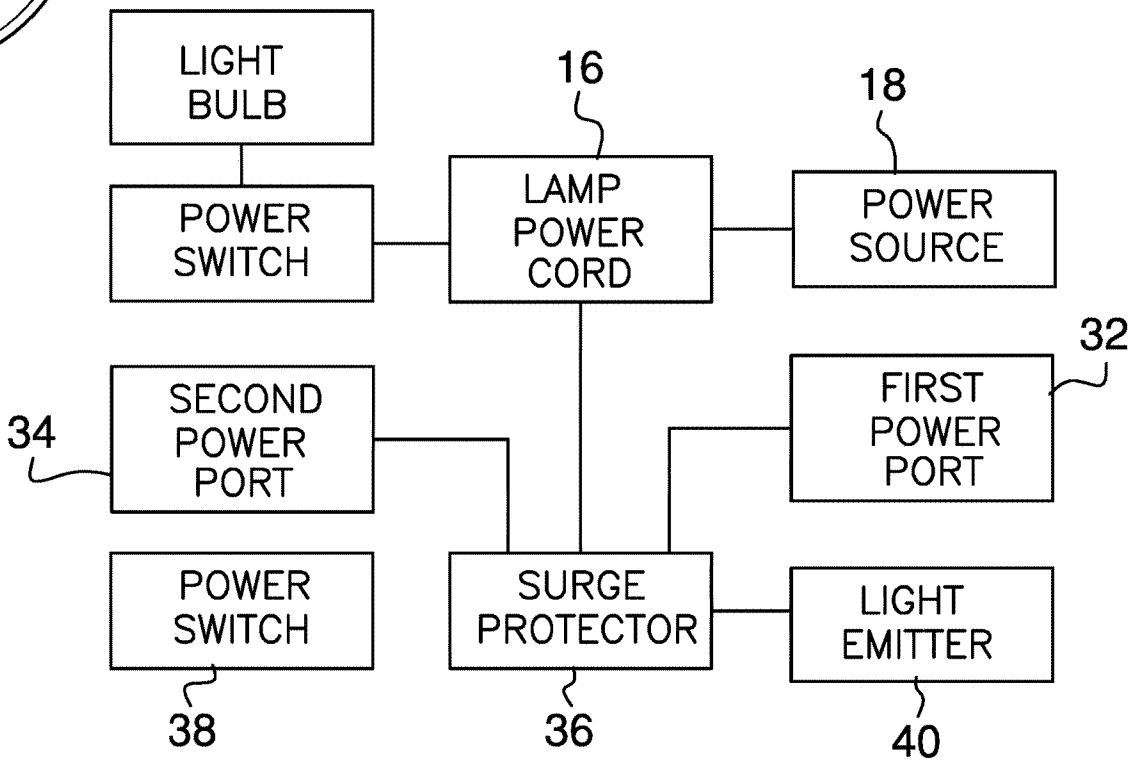
FIG. 6 is a schematic view of an embodiment of the disclosure.

A power button 38 is movably coupled to the housing 24 and the power button 38 is electrically coupled to the surge protector 36. The power button 38 turns the surge protector 36 on and off. Additionally, the power button 38 is positioned on the outer wall 30 of the housing 24. A light emitter 40 is coupled to the housing 24 and the light emitter 40 is electrically coupled to the surge protector 36. The light emitter 40 is turned on when the surge protector 36 is turned on for alerting a user that the surge protector 36 is turned on. The light emitter 40 is positioned on the outer wall 30 of the housing 24 and the light emitter 40 may comprise an LED or the like. In an alternative embodiment 41 as is best shown in FIG. 5, a plurality of first power ports 32 may be provided and a plurality of the second power ports 34 may be provided. The lamp 12 can be turned on regardless of whether the power button 38 is turned on or off.

In use, the lamp 12 is positioned at a location typical for a table lamp or the like. The power cord 16 is plugged into the power source 18 to supply electrical power to the lamp 12. An electronic device 42 that requires AC voltage for operation can be plugged into the first power port 32. In this way an alarm clock, or other electronic item commonly employed near a table lamp 12, can be powered by the first power port 32. Additionally, an electronic device 42 that requires DC voltage for operation can be plugged into the second power port 34. In this way a smart phone, or other electronic item that is charged with a usb cord, can be plugged into the second power port 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A power cable assembly being configured to supply electrical power to a lamp and a plurality of extrinsic electrical devices, said assembly comprising:

a lamp having a base;

a power cord extending outwardly from said base, said power cord being electrically coupled to a power source comprising a female electrical outlet, said power cord having a distal end with respect to said base, said distal end having a male plug being electrically coupled thereto for engaging the female electrical outlet;

a housing having said power cord extending therethrough, said housing having a first power port and a second power port, each of said first power port and said second power port being in electrical communication with said power cord for supplying electrical power to electronic devices, said housing having a first end, a second end and an outer wall extending therebetween, said first end being flat, said outer wall being continuously arcuate about a line extending through said first end and said second end such that said housing has a cylindrical shape, said outer wall tapering inwardly between said first end and said second end, said power cord extending through said first end and said second end, said first end having a diameter greater than a thickness of said power cord, said second end being sized equal to the thickness of said power cord, said power cord extending from a center of said first end; and a surge protector being positioned within said housing, each of said power cord, said first power port and said second power port being electrically coupled to said surge protector wherein said surge protector protects said power cord, said first power port and said second power port from electrical surges.

2. The assembly according to claim 1, wherein each of said first power port and said second power port is positioned on said first end of said housing.

3. The assembly according to claim 1, further comprising a power button being movably coupled to said housing, said power button being electrically, coupled to said surge protector, said power button turning said surge protector on and off, said power button being positioned on said outer wall of said housing.

4. The assembly according to claim 3, further comprising a light emitter being coupled to said housing; said light emitter being electrically coupled to said surge protector, said light emitter being turned on when said surge protector is turned on for alerting a user that said surge protector is turned on, said light emitter being positioned on said outer wall of said housing.

5. A power cable assembly being configured to supply electrical power to a lamp and a plurality of extrinsic electrical devices, said assembly comprising:

a lamp having a base;

a power cord extending outwardly from said base, said power cord being electrically coupled to a power source comprising a female electrical outlet, said power cord having a distal end with respect to said base, said distal end having a male plug being electrically coupled thereto for engaging the female electrical outlet;

a housing having said power cord extending therethrough, said housing having a first end, a second end and an outer wall extending therebetween, said first end being flat, said outer wall being continuously arcuate about a line extending through said first end and said second end such that said housing has a cylindrical shape, said outer wall tapering inwardly between said first end and said second end, said housing having a first power port and a second power port, each of said first power port and said second power port being in electrical communication with said power cord for supplying electrical power to electronic devices, each of said first power port and said second power port being positioned on said first end of said housing, said power cord extending through said first end and said second end, said first end having a diameter greater than a thickness of said power cord, said second end being sized equal to the thickness of said power cord, said power cord extending from a center of said first end;

a surge protector being positioned within said housing, each of said power cord, said first power port and said second power port being electrically coupled to said surge protector wherein said surge protector protects said power cord, said first power port and said second power port from electrical surges;

a power button being movably coupled to said housing, said power button being electrically coupled to said surge protector, said power button turning said surge protector on and off, said power button being positioned on said outer wall of said housing; and a light emitter being coupled to said housing, said light emitter being electrically coupled to said surge protector, said light emitter being turned on when said surge protector is turned on for alerting a user that said surge protector is turned on, said light emitter being positioned on said outer wall of said housing.

* * * * *